US007652234B2

(12) United States Patent
Shukrun

(10) Patent No.: US 7,652,234 B2
(45) Date of Patent: Jan. 26, 2010

(54) SYSTEM AND METHOD FOR DESTROYING FLYING OBJECTS

(75) Inventor: Eli Shukrun, Tel Aviv (IL)

(73) Assignee: Israel Aerospace Industries Ltd., Lod (IL)

( * ) Notice: Subject to any disclaimer, the term of this patent is extended or adjusted under 35 U.S.C. 154(b) by 50 days.

(21) Appl. No.: 11/660,538

(22) PCT Filed: Aug. 18, 2005

(86) PCT No.: PCT/IL2005/000900

§ 371 (c)(1),
(2), (4) Date: Feb. 20, 2007

(87) PCT Pub. No.: WO2006/025049

PCT Pub. Date: Mar. 9, 2006

(65) Prior Publication Data

US 2008/0017752 A1 Jan. 24, 2008

(30) Foreign Application Priority Data

Aug. 19, 2004 (IL) ..... 163609

(51) Int. Cl.
*F42B 15/01* (2006.01)
*F41G 7/00* (2006.01)
*F42B 15/00* (2006.01)

(52) U.S. Cl. ..... 244/3.15; 244/3.1; 244/3.11; 244/3.16; 89/1.11

(58) Field of Classification Search ..... 244/3.1–3.3; 342/13–16, 20, 52–58, 60–68, 175, 195; 89/1.11; 348/61, 143–147
See application file for complete search history.

(56) References Cited

U.S. PATENT DOCUMENTS

| | | | | |
|---|---|---|---|---|
| 3,721,410 | A * | 3/1973 | Anspacher | 244/3.14 |
| 3,778,007 | A * | 12/1973 | Kearney et al. | 244/3.14 |
| 3,962,537 | A * | 6/1976 | Kearns et al. | 244/3.14 |
| 4,354,419 | A * | 10/1982 | Patterson | 89/1.11 |
| 5,050,818 | A | 9/1991 | Sundermeyer | |
| 5,467,681 | A * | 11/1995 | Liberman | 89/1.11 |
| 5,537,909 | A * | 7/1996 | Schneider et al. | 89/1.11 |
| 5,537,928 | A * | 7/1996 | Schneider | 244/3.24 |
| 6,037,899 | A * | 3/2000 | Weber | 244/3.2 |
| 6,510,776 | B2 * | 1/2003 | Sirmalis et al. | 89/1.11 |
| 6,666,401 | B1 | 12/2003 | Mardirossian | |

(Continued)

FOREIGN PATENT DOCUMENTS

FR 2726643 A1 * 5/1996

*Primary Examiner*—Bernarr E Gregory
(74) *Attorney, Agent, or Firm*—The Nath Law Group; Susanne M. Hopkins; Jiaxiao Zhang

(57) ABSTRACT

A method for obtaining a sky view of a battle site, comprising launching an interceptor (2) towards at least one detected flying threat (3); the interceptor (2) tracking the threat (3) using at least one remote sensor for achieving a kill of the threat (3) at a designated kill site (4) being at a large range from the at least one sensor; when the interceptor (2) approaches the kill site (4), releasing from the interceptor (2) at least one detachable vehicle (7) that includes at least one local sensor (8) for sensing the kill site (4) from a range considerably shorter than the large range and communicating the sensed data.

19 Claims, 5 Drawing Sheets

U.S. PATENT DOCUMENTS 6,705,573 B2 * 3/2004 McDonnell ..... 89/1.11
6,739,232 B2 * 5/2004 Porter et al. ..... 89/1.11
2002/0166442 A1 * 11/2002 Sirmalis et al. ..... 89/1.11

* cited by examiner

SYSTEM AND METHOD FOR DESTROYING FLYING OBJECTS

FIELD OF THE INVENTION

The present invention is in the general field of generating picture of battle site.

BACKGROUND OF THE INVENTION

Ground-to-air missiles are designated to kill flying objects typically enemy aircrafts. Some missiles such as the one known as the "Arrow", manufactured by Israel Aircraft Industries, are capable of destroying enemy ground-to-ground ballistic missiles such as the "Scud" series manufactured by former Soviet Union and upgraded by other countries, or the "Shihab" series manufactured by the Islamic republic of Iran.

During missile theatre defense, there is a need to know the real kill picture of the threat. For example, it may well be the case that the target flying object (threat) has been damaged, but not destroyed. Note that, as a rule, the encounter between the ballistic missile and the interceptor (kill site) occurs at large ranges. Such ranges facilitate a very low resolution of the ground sensors, such as cameras and radars which are physically displaced in remote sites relative to the kill scene site, and therefore it is difficult to provide accurate kill assessment. Moreover, clouds and other atmospheric interferences may adversely affect the ability to sense the kill site.

Accordingly, due to the insufficient kill assessment, the ground sensors may erroneously indicate on successful kill, whereas the threat is only partially damaged (e.g. the warhead is still active) and continues in its flight trajectory towards the friendly territory. It may well be the case that only when the threat approaches the friendly territory it is spotted by the sensors as still harmful, due to the fact that the sensors can now observe the threat in a higher resolution.

At this stage it would be difficult to neutralize the threat since it is as a rule close to its destination in the friendly territory and has accumulated high velocity, thus hindering the prospects of another attempt of successful kill by launching one or a salvo of interceptors from the friendly territory.

There is thus a need to have substantially real-time indication (possibly visual indication) of the kill picture of the kill site, thereby affording among others better kill assessment, discrimination between real threat and decoys and other functionalities, all as required depending upon the particular application.

SUMMARY OF THE INVENTION

The invention provides for a method for obtaining a sky view of a battle site, comprising, a) launching an interceptor towards at least one detected flying threat;

b) the interceptor tracking the threat using at least one remote sensor for achieving a kill of the threat at a designated kill site being at a large range from the at least one sensor;

c) when the interceptor approaches the kill site, releasing from the interceptor at least one detachable vehicle that includes at least one local sensor for sensing the kill site from a range considerably shorter than said large range and communicating the sensed data.

The invention further provides for a method for obtaining a sky view of a battle site, comprising, a) launching an interceptor towards at least one detected threat;

b) the interceptor tracking the threat using at least one remote sensor for achieving a kill of the threat at a designated kill site;

c) when the interceptor approaches the kill site, releasing from the interceptor at least one detachable vehicle that includes at least one local sensor for sensing the kill site and communicating the sensed data.

Still further, the invention provides for a method for obtaining a sky view of a battle site in a ground station, comprising, launching an interceptor towards at least one detected flying threat;

tracking the interceptor using at least one remote sensor for achieving a kill of the threat at a designated kill site being at a large range from the ground station;

when the interceptor approaches the kill site, releasing from the interceptor at least one detachable vehicle that includes at least one local sensor for sensing the kill site from a range considerably shorter than said large range and receiving the sensed data, for constructing a high resolution view of the battle site.

The invention further provides for a method for obtaining a sky view of an event site, comprising, launching an interceptor towards at least one detected threat;

the interceptor tracking the threat;

when the interceptor approaches the event, releasing from the interceptor at least one detachable vehicle that includes at least one local sensor for sensing the event and communicating the sensed data.

The invention further provides for a device for obtaining a sky view of a battle site, this device including a vehicle detachable to an interceptor; the interceptor is configured to be launched towards at least one detected flying threat; the interceptor is further configured to track the threat using at least one remote sensor for achieving a kill of the threat at a designated kill site being at a large range from the at least one sensor; the vehicle is releasable from the interceptor upon approaching the kill site, the vehicle comprising:

at least one local sensor configured to sense the kill site from a range considerably shorter than said large range and for generating digital data indicative thereof; and communication means configured to communicate the sensed data.

BRIEF DESCRIPTION OF THE DRAWINGS

For a better understanding, the invention will now be described, by way of example only, with reference to the accompanying drawings, in which.

DETAILED DESCRIPTION OF SPECIFIC EMBODIMENTS

Figure 1:
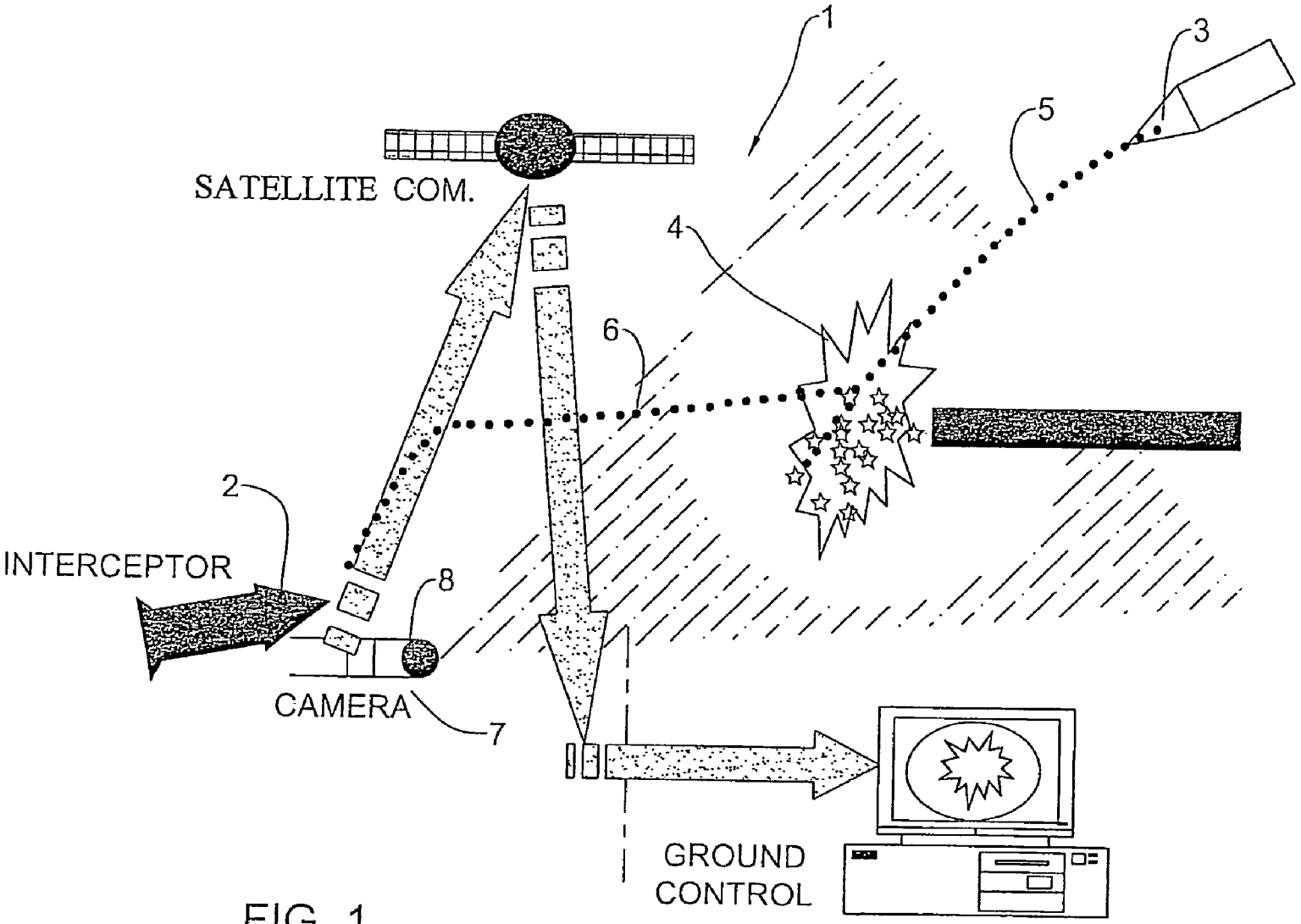
FIG. 1 illustrates a general system architecture, in accordance with an embodiment of the invention.

Turning, at first, to FIG. 1, there is shown a general system architecture (1) in accordance with an embodiment of the invention. As shown, an interceptor (2), e.g. ground to air missile, such as the "Arrow" is launched towards detected threat (3) (e.g. of the Scud series), for intercepting the latter within a kill site (4). Note that the term kill site is not bound to the specific boundaries of the encounter between the interceptor and the threat, but rather is may be also at the vicinity and/or the surrounding area, all as required and appropriate.

Note that the flight trajectories of the threat and the interceptor are tracked, and on the basis of the estimated flight trajectory (5) of the threat and trajectory (6) of the interceptor, the kill site (4) can be predicted. The tracking of the flight trajectories and the determination of the kill site by ground station and possibly other means fitted in the interceptor (or elsewhere) is generally known per se and therefore will not be expounded upon herein. Note that the invention is not bound by any specific trajectory tracking and estimation techniques.

Note that the kill site is normally observed by ground/satellite and/or other remote sensors (such as video cameras), however, due to the fact that the interception is encountered at a large distance from the interceptor's launching site, the resolution of observing the kill site is low and accordingly the kill assessment may be poor. In other words, it may well be the case that on the basis of the view obtained by the ground sensors, one may conclude that the threat has been destroyed and that only harmless fragments thereof continue to fly. However, as the fragments approach the defended area and the ground sensor(s) can view them in a better resolution, it may be noticed that one (or more) of "the fragments" is, in fact, the warhead which proceeds in its flight trajectory and may hit the defended area, giving rise to dire consequences. At this stage, when the undamaged threat (by this example the surviving warhead) approaches the defended area it would be difficult to destroy it, since it moves faster and the remaining time until hitting the targeted area is short, and consequently the prospects of successful hit by another launched interceptor (or salvo of interceptors) are considerably lower.

Reverting now to FIG. 1, in accordance with an embodiment of the invention a detachable vehicle (7) that includes sensor (8) (e.g. an image acquisition device such as a video camera) is released from the interceptor (2) as the latter approaches the estimated kill site (4). The calculation of the timing for releasing the detachable vehicle will be discussed in greater detail below, with reference to FIGS. 6 and 7.

Note that the invention is not bound by any specific manner of releasing the vehicle, and the latter can be launched, dropped or any other releasing manner, all depending upon the particular embodiment. A non-limiting embodiment describing the release of the detachable vehicle will be described with reference to FIG. 6. below.

Figure 2:
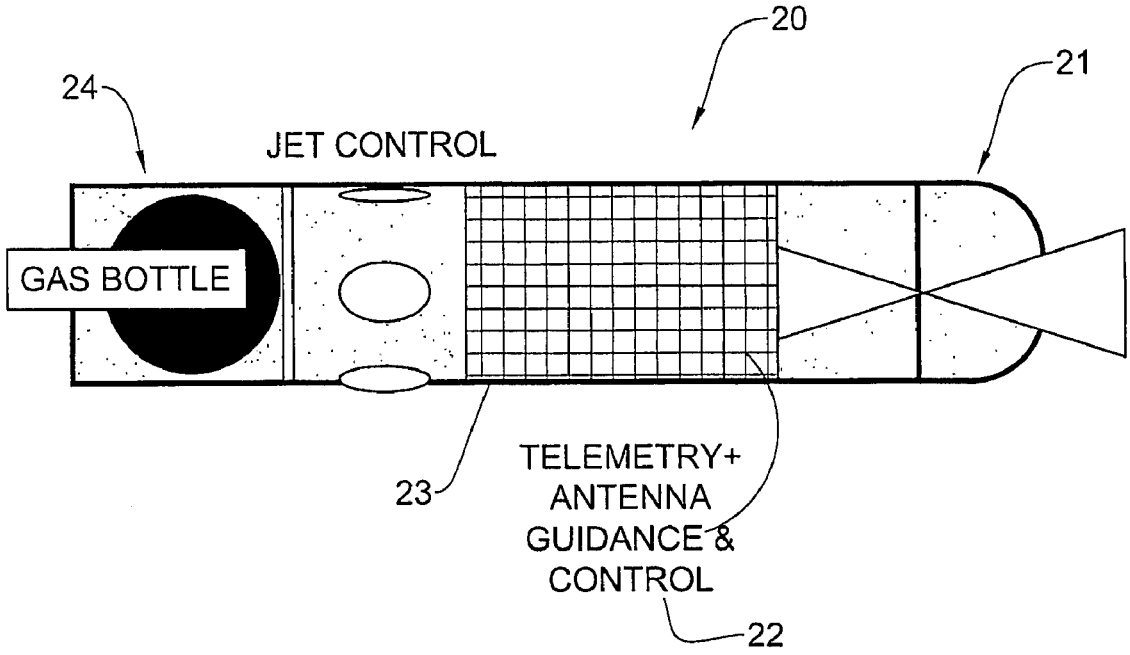
FIG. 2 illustrates a general block diagram of a detachable vehicle, in accordance with an embodiment of the invention.

Turning now to FIG. 2, there is shown a general block diagram of a detachable vehicle (20), in accordance with an embodiment of the invention. As shown, the vehicle is fitted with a sensor (21) at the front end thereof. By this specific example, the sensor is a camera of the CCD video type covering a predefined field of view. Note that the invention is not bound by the specific use of video camera as the sensor and accordingly other sensors such as other image acquisition devices (e.g. IR camera, radar, etc.) may be employed.

The vehicle further includes known per se guidance and control system (22) for guiding the camera to observe the estimated kill site, and Telemetry and Antenna devices (23) (also known per se), for facilitating broadcast of the acquired image to the ground station, typically although not necessarily, through satellite communication. The vehicle further includes a propulsion system, by this specific embodiment Jet control and GAS bottle (24) for steering the vehicle in response to steering commands received from the guidance system (22), all as generally known per se. The invention is by no means bound by a detachable vehicle of the kind described with reference to FIG. 2.

Figure 3:
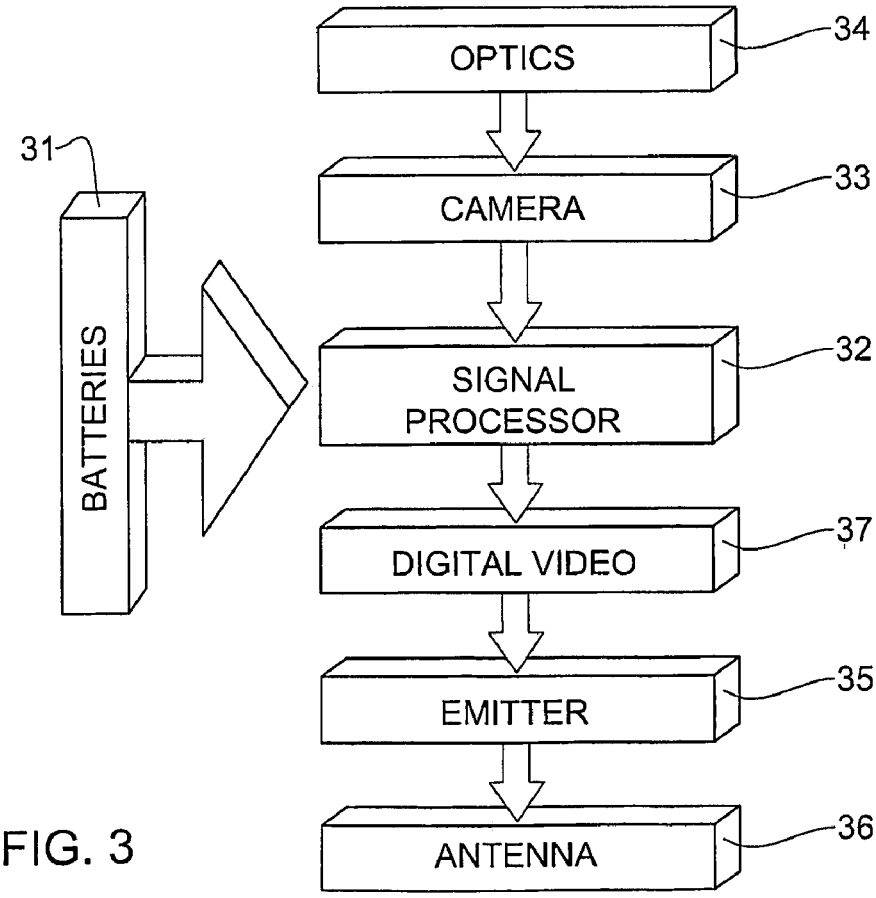
FIG. 3 illustrates a block diagram of the modules employed by the vehicle of FIG. 2, in accordance with an embodiment of the invention.

Turning now to FIG. 3, there is shown a block diagram of the various modules employed in the vehicle of FIG. 2, in accordance with an embodiment of the invention. As shown, a power source (31) feeds a signal processor (32) configured to perform among others the following operations: receiving data acquired by the camera (33) through optics (34). The latter are capable of point control of the field of view of the camera, in a generally known per se manner. The camera, in its turn, can be configured to desired e.g. resolution, frame rate, colors and/or other parameters, all as generally known per se. The so obtained images are subjected to known per se compression techniques (by the signal processor 32), and are sent through emitter (35) to antenna (36) for broadcasting to the ground station through the satellite(s), as shown in FIG. 1. Note that the various modules 33, 34, 32 and the digital video 37 are used to generate succession of video images, in a known per se manner. The invention is not bound by this approach.

Note that the overall sky view of the battle site (including the kill zone) can be constructed in the vehicle (using processor 32) or in the ground station, or partially in the vehicle and partially in the ground station, all depending upon the particular application.

Those versed in the art will readily appreciate that the invention is not bound by the specific configurations of the modules as depicted in FIG. 3 and accordingly some of the modules may be modified and/or others added, all depending upon the particular application.

Figure 4A:
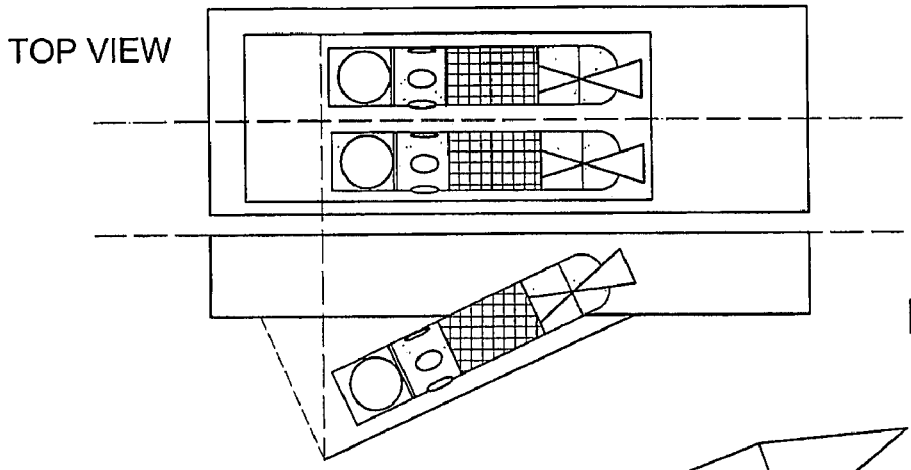
FIGS. 4A-B illustrate schematically a detachable vehicle accommodated within an interceptor, in accordance with an embodiment of the invention.
Figure 4B:
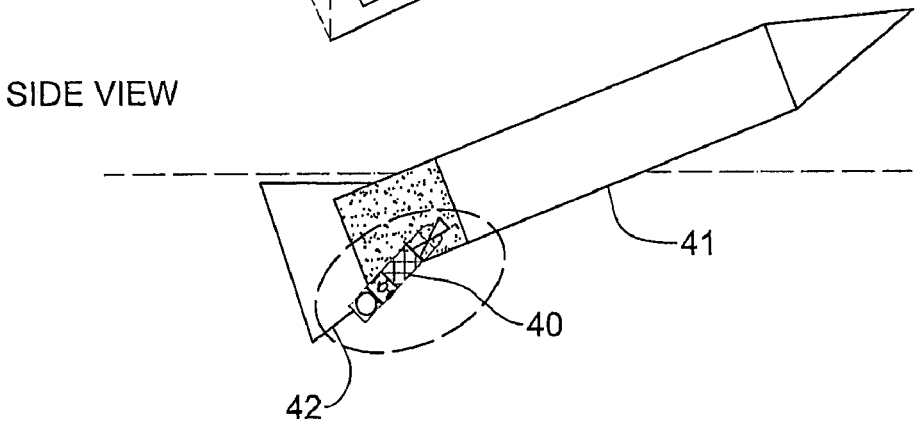

Turning now to FIGS. 4A-B, there is shown schematically a respective top view and side view of detachable vehicle (40) (of the kind depicted in FIG. 2) accommodated within the interceptor (41), in accordance with an embodiment of the invention. As shown, the vehicle is fitted at the external surface (42) of the interceptor.

By one embodiment, two or more vehicles are fitted within the interceptor. A no-limiting use of two or more vehicles would be to release the first one to observe the estimated kill site between the interceptor and the threat (in the manner specified herein). The other vehicle would be released to view a different event in the sky, say a fireball of a previous kill. More specifically, when an interceptor encounters a threat, a fireball is generated in the sky. The fireball may exist for several seconds but sometimes minutes or more before disappearing. In the case of many threats launched towards the friendly territory, many interceptors are likely to be launched in order to intercept the threats. If, for example, an interceptor hits a threat giving rise to a fireball, and in the case that there are additional flying threats in the close vicinity to the so destroyed threat, it would be desired to avoid a situation that the next launched interceptor (targeted another threat), would pass through or in close vicinity to the fireball that was generated as a result of the previous encounter. Now, the vehicle that was released from the previous interceptor can provide a good picture of the kill site and help to assess whether a successful kill has occurred and it can also provide a good quality picture of the resulting fireball, however, since the vehicle continues in its flight trajectory, the picture of the fireball can be provided only for a short period (up to a few seconds) following the encounter, whereas as specified before, the fireball may remain for minutes. Now, when the next interceptor is launched and targeted against another threat, one of its vehicles can be pointed to the location of the fireball in order to assess the fireball's current state, enabling thus the ground station to plan a flight trajectory that does not pass through or in close vicinity to the fireball, if still active. The other vehicle would be used in a standard fashion to view the estimated kill site between the interceptor and its designated threat.

The latter scenario illustrates one out of many possible variants of using one or more of the vehicles to generate a picture of an event of interest.

Figure 5:
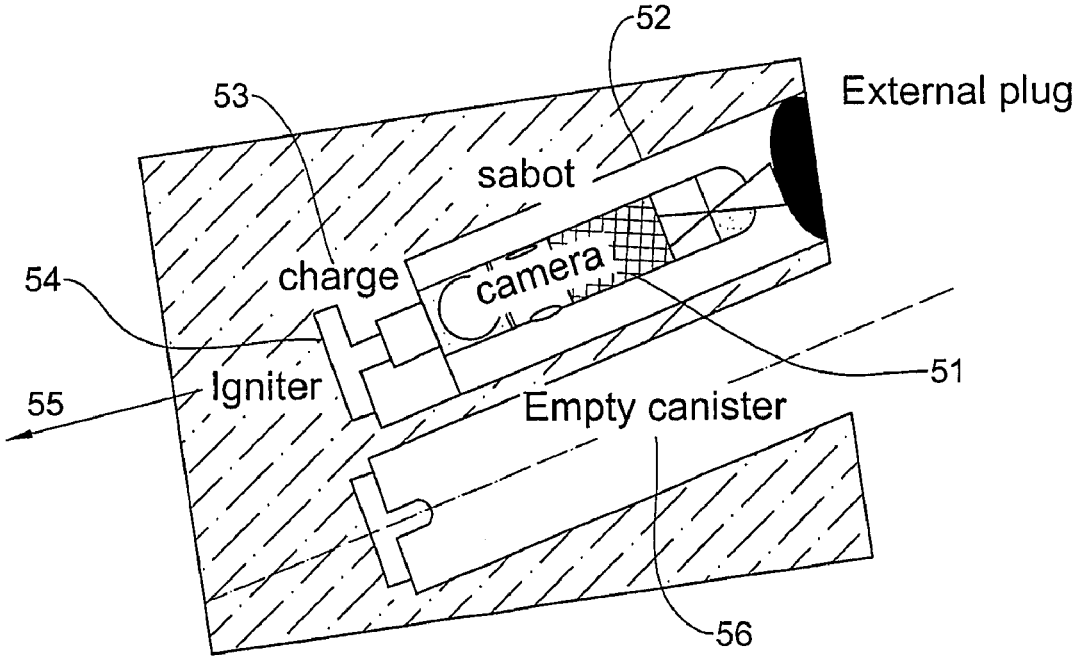
FIG. 5 illustrates schematically the components that are employed for releasing the detachable vehicle, in accordance with an embodiment of the invention.

FIG. 5 illustrates schematically the components that are employed for releasing the detachable vehicle, in accordance with an embodiment of the invention. The vehicle (51) is accommodated within a sabot (52) that is coupled to a charge (53) and igniter (54). The vehicle, sabot charge and igniter are all fitted in a canister (56). Once the vehicle is released (as will be explained below) the content of the canister is ejected and it remains empty. The ejection (being a non-limiting example of releasing the vehicle) is generally known per se. Thus, when receiving an eject command (as will be explained in greater detail below), the igniter (54) ignites the charge (53) which activates the sabot (52) giving rise to ejection of the vehicle in the direction pointed by arrow (55) (opposite the flight direction of the interceptor). Note, however, that whilst by this embodiment the vehicle is ejected in a direction opposite to the flight direction of interceptor (2), the cumulative vector velocity of the vehicle is nevertheless in the flight direction of the interceptor (and approaching the kill site), due to the velocity conferred to the vehicle when it was hosted by the interceptor, prior to the release.

Figure 6:
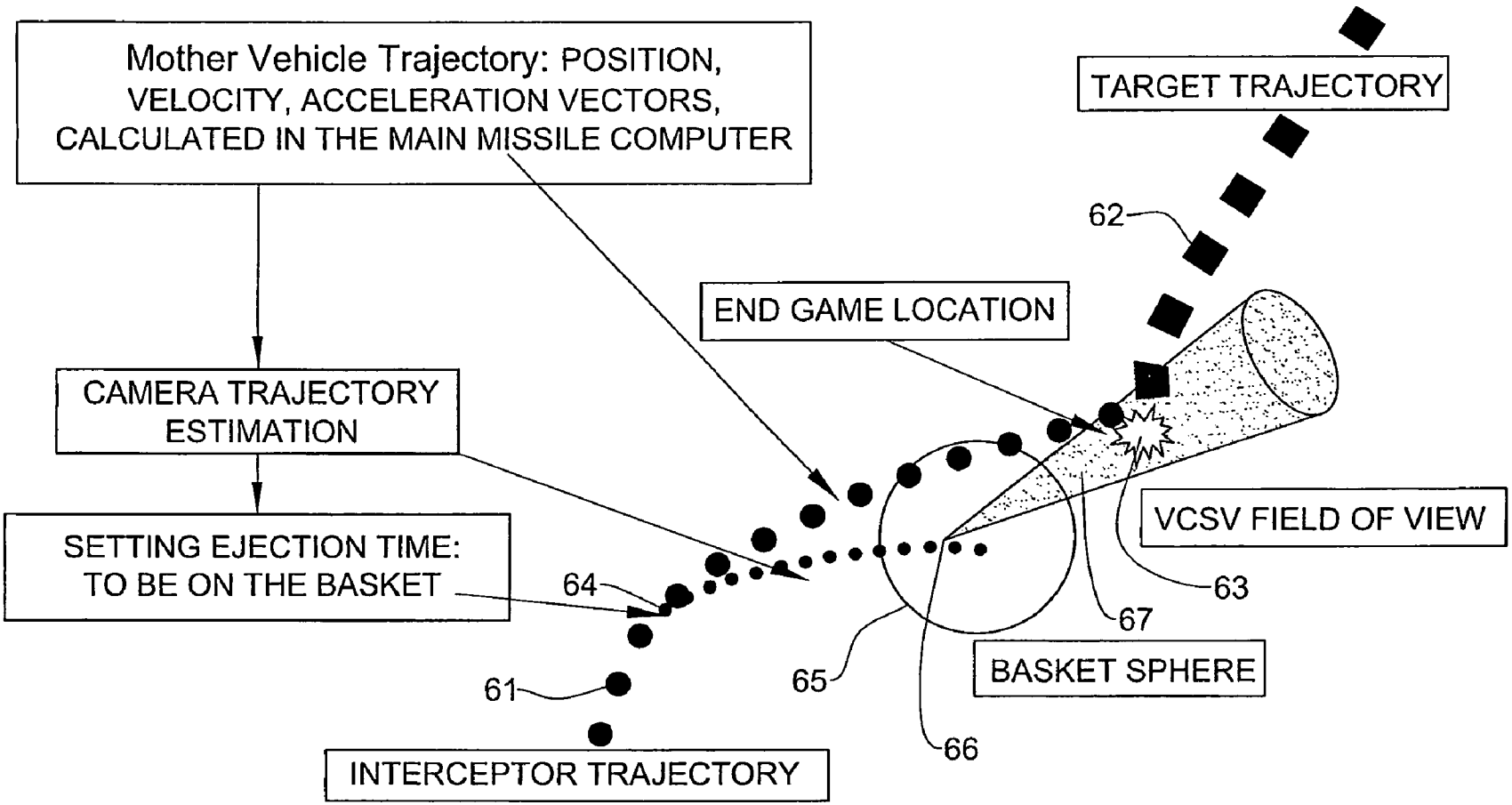
FIG. 6 illustrates a typical interception scenario, in accordance with an embodiment of the invention.

Turning now to FIG. 6, there is shown a typical interception scenario, in accordance with an embodiment of the invention. Thus, the estimated interceptor's trajectory (61) is shown (the calculation thereof can be performed in either or both the on-board interceptor's processor and the ground processor, based e.g. on the position, velocity, and acceleration data). Also shown is the estimated threat trajectory (62) calculated by the remote stations, based on the threat tracked data.

The kill site (63) is illustrated at the intersection of the trajectories (61 and 62). Note, that as is generally known per se, for achieving a kill the interceptor does not necessarily have to collide with the threat, and depending upon the characteristic of the interceptor and the threat, a successful kill can occur even when the interceptor passes in the vicinity of the threat.

Note that by one embodiment, the timing (64) of the ejection of the vehicle from the interceptor is calculated in a manner that will allow the camera to fall in the basket sphere (65). The latter is defined in a manner such that at any point in the basket (e.g. 66) the field of view of the camera embraces the kill site. As shown in FIG. 6, the field of view (67) of the camera that extends from point (66) within sphere (65) embraces the estimated kill site (63). Note that the manner of calculating the release timing is not bound by the specific manner described above, and accordingly other variants for calculating the release timing are applicable.

Figure 7:
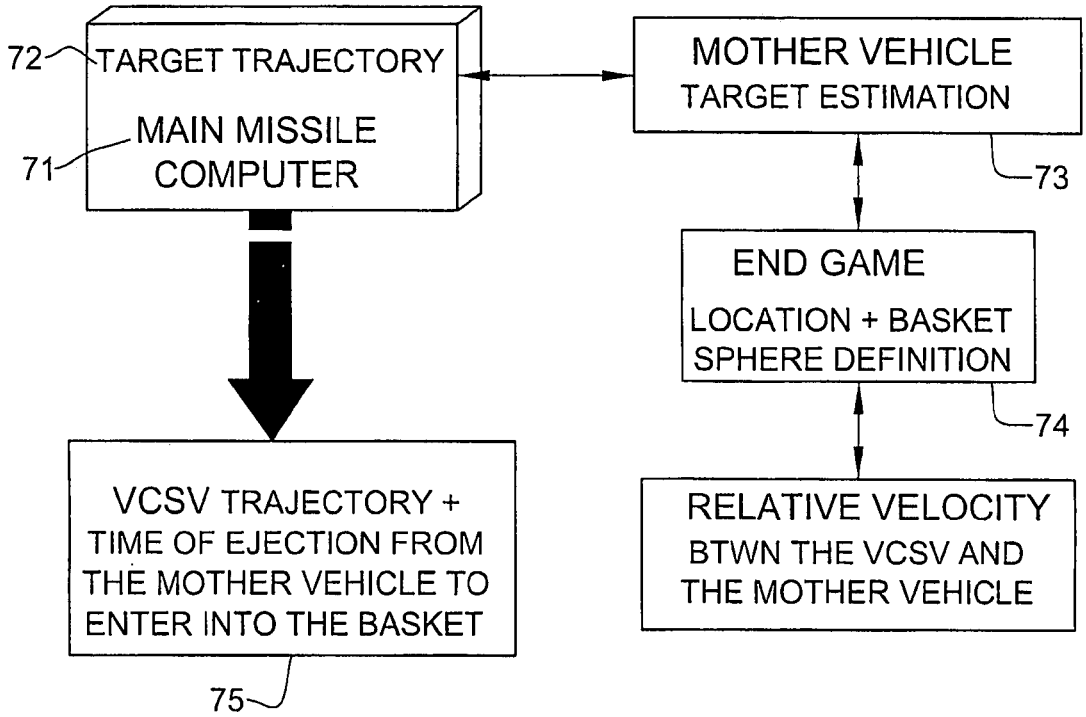
FIG. 7 illustrates a block diagram of the computational tasks performed by the vehicle on board processor, in accordance with an embodiment of the invention.

Turning now to FIG. 7, there is shown a block diagram of the computational tasks performed by the vehicle's on board processor (71) (32 in FIG. 3), in accordance with an embodiment of the invention. Thus, based on the target's estimated trajectory data (72) received from the ground station, as well as the interceptor's estimated trajectory (73) (as received from the interceptor) as well as the basket sphere (see FIG. 6) definition module (74), the processor is capable of calculating the timing of the release of the vehicle from the interceptor (76), as explained in greater detail above, with reference to FIG. 6. Note that the relative velocity module would take into account the relative velocity between the interceptor and the detachable vehicle. The relative velocity affects the timing that the vehicle will reach the sphere and therefore need to be taken into account when calculating the release timing.

Note that the calculations of each of the parameters per se (estimated flight trajectories, basket sphere and consequently the release timing) is generally known and therefore is not further expounded upon herein. As mentioned above, the invention is not bound by the specific manner of calculating the release timing as described with reference to the specific example of FIG. 7.

Figure 8:
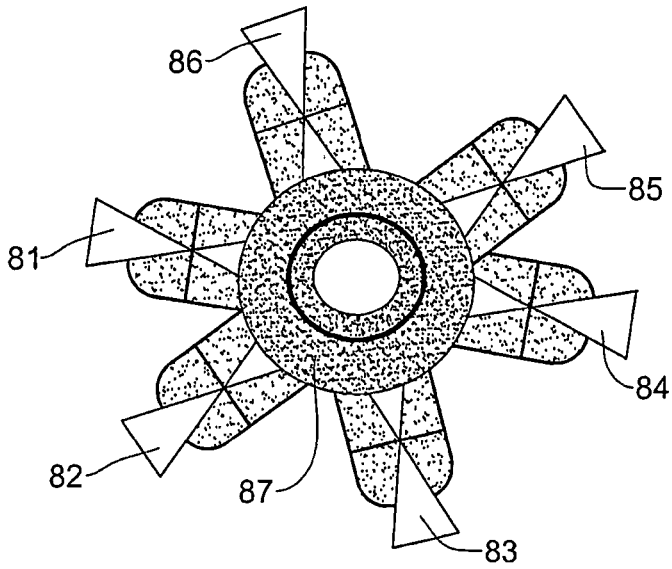
FIG. 8 illustrates a layout of camera's placement on the detachable vehicle, in accordance with an embodiment of the invention.

Turning to FIG. 8, it illustrates a layout of camera's placement on the detachable vehicle, in accordance with an embodiment of the invention. By this example, six cameras (81 to 86) are placed at the periphery of the vehicle (87), each covering a predetermined field of view, and all covering substantially 360 degrees. Using this layout can simplify the architecture of the vehicle (and thereby reduce costs) by obviating the use of guidance and steering means. The reason is simply that at any stage the kill site is observed by one or more of the cameras even if the vehicle is tumbling. Note that by this embodiment there is a need to construct the kill site view from the distinct image obtained by the various cameras, and this can be achieved e.g. by the on-board processor of the vehicle, by the ground station or by task(s) assigned to both of them. Those versed in the art will readily appreciate that the invention is not bound by the specific configuration described with reference of FIG. 8. Thus, by way of example, it is not bound by the number of cameras, their placement scheme (shown by this specific example at the vehicle's periphery ) as well as the manner of constructing the picture of the kill site.

The so constructed kill site picture, in accordance with various embodiments of the invention, constitutes an advantage over the prior art solutions in that the high resolution picture facilitates substantially a real-time kill assessment. Thus, for instance, due to the so obtained high resolution picture it can be readily determined whether the threat's warhead has been destroyed, and if not, another interceptor or salvo of interceptors cain be launched, leaving the newly launched interceptor ample time to have a second attempt to destroy the surviving threat's warhead.

Note also that the high quality kill scene would allow the ground station to identify decoys and if a decoy is encountered it may be necessary to readily launch another interceptor in order to kill the real threat.

Note that the use of detachable vehicle or vehicles in accordance with the invention is not bound to specific events in the sky and the operational scenarios described herein are provided by way of non-limiting examples only.

The present invention has been described with a certain degree of particularity, but those versed in the art will readily appreciate that various alterations and modifications may be carried out, without departing from the scope of the following claims:

The invention claimed is:

1. A method for obtaining a sky view of a battle site, comprising, a) launching an interceptor missile toward at least one detected flying threat;

b) tracking the at least one detected flying threat using at least one remote sensor, the interceptor missile configured to achieve a kill of the at least one detected flying threat at a designated aerial kill site at a large range from the at least one remote sensor;

c) releasing from the interceptor missile, when the interceptor missile approaches the kill site, at least one detachable vehicle comprising at least one guidable local sensor configured to sense, within a basket sphere, the aerial kill site from a range shorter than the large range; and d) communicating the sensed data, wherein from any point in the basket sphere the at least one guidable local sensor is capable of sensing the aerial kill site and the basket sphere is determined based upon a threat flying trajectory and an interceptor missile flying trajectory.

2. The method according to claim 1, wherein the flying threat is a ground-to-ground missile.

3. The method according to claim 2, wherein the ground-to-ground missile is of the "Scud" series.

4. The method according to claim 1, wherein the interceptor missile is of the "Arrow" series.

5. The method according to claim 1, wherein at least one of the local sensors is an image acquisition device, and the method further comprises acquiring a succession of images of the kill site and transmitting at least one of the images through a communication channel.

6. The method according to claim 5, wherein the image acquisition device is a video camera.

7. The method according to claim 6, wherein the detachable vehicle comprises a propelling system associated with a guidance system, and the method further comprises steering the at least one video camera for acquiring images of the kill site.

8. The method according to claim 1, wherein the detachable vehicle comprises a propelling system associated with a guidance system, and the method further comprises steering the at least one guidable local sensor substantially toward the kill site.

9. The method according to claim 1, wherein the detachable vehicle comprises at least two image acquisition devices, and the method further comprises determining a field of view, respective to each of the acquisition devices, each field of view being a predetermined field of view respective to each of the acquisition devices;

acquiring a succession of images, using each of the at least two acquisition devices, at the predetermined field of view respective to each of the acquisition devices, and transmitting at least one of the images through a communication channel, for constructing a consolidated view of the kill site.

10. The method according to claim 9, wherein each of the at least two image acquisition devices is a video camera.

11. The method according to claim 1, further comprising receiving the sensed data, for constructing a high resolution view of the battle site.

12. A method for obtaining a sky view of an event site, comprising:

a) launching an interceptor missile toward at least one detected threat; and b) the interceptor missile tracking the at least one detected threat, the interceptor missile comprising at least one detachable vehicle comprising at least one guidable local sensor configured to sense the event and to communicate the sensed data, and wherein the tracking uses at least one remote sensor for achieving a kill of the threat at a designated kill site, where the event site is different than the kill site.

13. The method according to claim 12, wherein the event site includes a fireball of an encounter between a previous threat and the interceptor missile.

14. A device for obtaining a sky view of a battle site, the device comprising:

an interceptor missile configured to be launched toward at least one detected flying threat and to track the at least one detected flying threat using at least one remote sensor for achieving a kill of the at least one detected flying threat at a designated aerial kill site at a large range from the at least one remote sensor, based on a threat flying trajectory and an interceptor missile flying trajectory; and a vehicle detachable from the interceptor missile, the vehicle is releasable from the interceptor missile upon approaching the aerial kill site, the vehicle comprising:

at least one guidable local sensor configured to sense, within a basket sphere, the aerial kill site from a range shorter than the large range and configured to generate digital data indicative thereof, wherein from any point in the basket sphere the at least one guidable local sensor is capable of sensing the aerial kill site and the basket sphere is determined based upon the threat flying trajectory and the interceptor missile flying trajectory; and communication means configured to communicate the sensed data.

15. The device according to claim 14, wherein at least one of the guidable local sensors is an image acquisition device configured to acquire a succession of images of the kill scene, and the communication means are configured to transmit at least one of the images.

16. The device according to claim 15, wherein the image acquisition device is a video camera.

17. The device according to claim 16, wherein the detachable vehicle comprises a propelling system associated with a guidance system configured to steer the at least one guidable local sensor substantially toward the kill site.

18. The device according to claim 16, wherein the detachable vehicle comprises a propelling system associated with guidance system configured to steer the at least one video camera for acquiring images of the kill site.

19. The device according to claim 14, wherein the detachable vehicle comprises at least two image acquisition devices; each one of the acquisition devices is configured to acquire a succession of images at a respective predetermined field of view, the communication means are configured to transmit at least one of the images, whereby a consolidated view of the kill site can be constructed.

* * * * *